US012313371B2

(12) United States Patent
McPherson

(10) Patent No.: US 12,313,371 B2
(45) Date of Patent: May 27, 2025

(54) ARCHERY BOW LIMB CONSTRUCTION

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 97 days.

(21) Appl. No.: 18/114,048

(22) Filed: Feb. 24, 2023

(65) Prior Publication Data

US 2023/0304768 A1 Sep. 28, 2023

Related U.S. Application Data

(60) Provisional application No. 63/424,072, filed on Nov. 9, 2022, provisional application No. 63/314,241, filed on Feb. 25, 2022.

(51) Int. Cl.
*F41B 5/14* (2006.01)
*F41B 5/10* (2006.01)

(52) U.S. Cl.
CPC ..... *F41B 5/1426* (2013.01); *F41B 5/14* (2013.01); *F41B 5/10* (2013.01)

(58) Field of Classification Search
CPC ..... F41B 5/1426; F41B 5/052; F41B 5/123; F41B 5/10; F41B 5/14
See application file for complete search history.

(56) References Cited

U.S. PATENT DOCUMENTS

| | | | | |
|---|---|---|---|---|
| 6,024,076 | A * | 2/2000 | Laborde | F41B 5/0026 124/23.1 |
| 6,684,870 | B1 | 2/2004 | Land | |
| 8,225,778 | B2 | 7/2012 | Walk et al. | |
| 8,505,526 | B1 * | 8/2013 | McPherson | F41B 5/105 124/23.1 |
| 8,839,775 | B2 | 9/2014 | Wasilewski et al. | |
| 9,689,640 | B2 | 6/2017 | Houle | |
| 11,029,121 | B2 | 6/2021 | McPherson | |
| 2003/0094168 | A1 * | 5/2003 | Sims | F41B 5/1426 124/89 |
| 2004/0077440 | A1 * | 4/2004 | Kronfeld | F41B 5/1426 473/578 |
| 2009/0241928 | A1 * | 10/2009 | Blosser | F41B 5/0026 124/88 |
| 2013/0047972 | A1 | 2/2013 | Walk et al. | |
| 2019/0120588 | A1 | 4/2019 | Marriott et al. | |
| 2019/0128635 | A1 * | 5/2019 | McPherson | F41B 5/10 |
| 2019/0301830 | A1 * | 10/2019 | McPherson | F41B 5/1426 |
| 2020/0132408 | A1 * | 4/2020 | Gann | F41B 5/10 |

* cited by examiner

*Primary Examiner* — John E Simms, Jr.
(74) *Attorney, Agent, or Firm* — Laabs Intellectual Property

(57) ABSTRACT

In some embodiments, an archery bow limb assembly comprises a first limb, a second limb and a spacer. The spacer contacts the first limb and the second limb. The first limb comprises a limb material. The spacer comprises a spacer material comprising a higher clastic modulus than the limb material. A width of the spacer is less than a width of the first limb.

16 Claims, 8 Drawing Sheets

ARCHERY BOW LIMB CONSTRUCTION

CROSS-REFERENCE TO RELATED APPLICATIONS

This application claims the benefit of U.S. Patent Application No. 63/314,241 filed Feb. 25, 2022, and the benefit of U.S. Patent Application No. 63/424,072 filed Nov. 9, 2022, the entire content of each of which are hereby incorporated herein by reference.

BACKGROUND OF THE INVENTION

This invention relates generally to archery bows and more specifically to limb technology useful in archery bows. When an arrow is launched from an archery bow, a user might feel an initial force shock and residual vibrations. It is desirable to minimize shock and vibration in an archery bow.

There remains a need for novel archery bow structures that provide better performance than prior archery bows.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

In some embodiments, an archery bow limb assembly comprises a first limb, a second limb and a spacer. The spacer contacts the first limb and the second limb. The first limb comprises a limb material. The spacer comprises a spacer material comprising a higher elastic modulus than the limb material. A width of the spacer is less than a width of the first limb.

In some embodiments, the first limb comprises a first engagement region arranged to be supported by a limb cup, and the spacer contacts the first engagement region. In some embodiments, the first limb comprises a working length portion and the spacer contacts the working length portion.

In some embodiments, the first limb comprises a second engagement region arranged to support an axle or bowstring, and the spacer contacts the second engagement region.

In some embodiments, the spacer comprises a body portion and a flange, wherein the flange comprises a greater width than the body. In some embodiments, the flange contacts a first end surface of the first limb. In some embodiments, the flange contacts a second end surface of the first limb. In some embodiments, the flange contacts top surfaces of the first limb and the second limb. In some embodiments, the flange contacts bottom surfaces of the first limb and the second limb.

In some embodiments, the spacer extends an entire length of the first limb.

In some embodiments, the first limb comprises an aperture arranged to receive an axle and the spacer comprises an aperture arranged to receive the axle.

In some embodiments, a sidewall of the first limb comprises a lateral recess and the spacer comprises a protrusion oriented in the lateral recess. In some embodiments, a sidewall of the second limb comprises a second lateral recess and the protrusion is oriented in the second lateral recess.

In some embodiments, the limb assembly comprises a bearing accessory attached to the first limb and the second limb. In some embodiments, the bearing accessory comprises a groove and a portion of the spacer is oriented in the groove.

In some embodiments, a limb cup is arranged to support the first limb and the second limb. In some embodiments, the limb cup comprises a groove and a portion of the spacer oriented in the groove.

In some embodiments, the first limb comprises a different width from the second limb.

In some embodiments, the limb material comprises a composite material comprising reinforcing fibers and the spacer comprises an elastomeric material.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
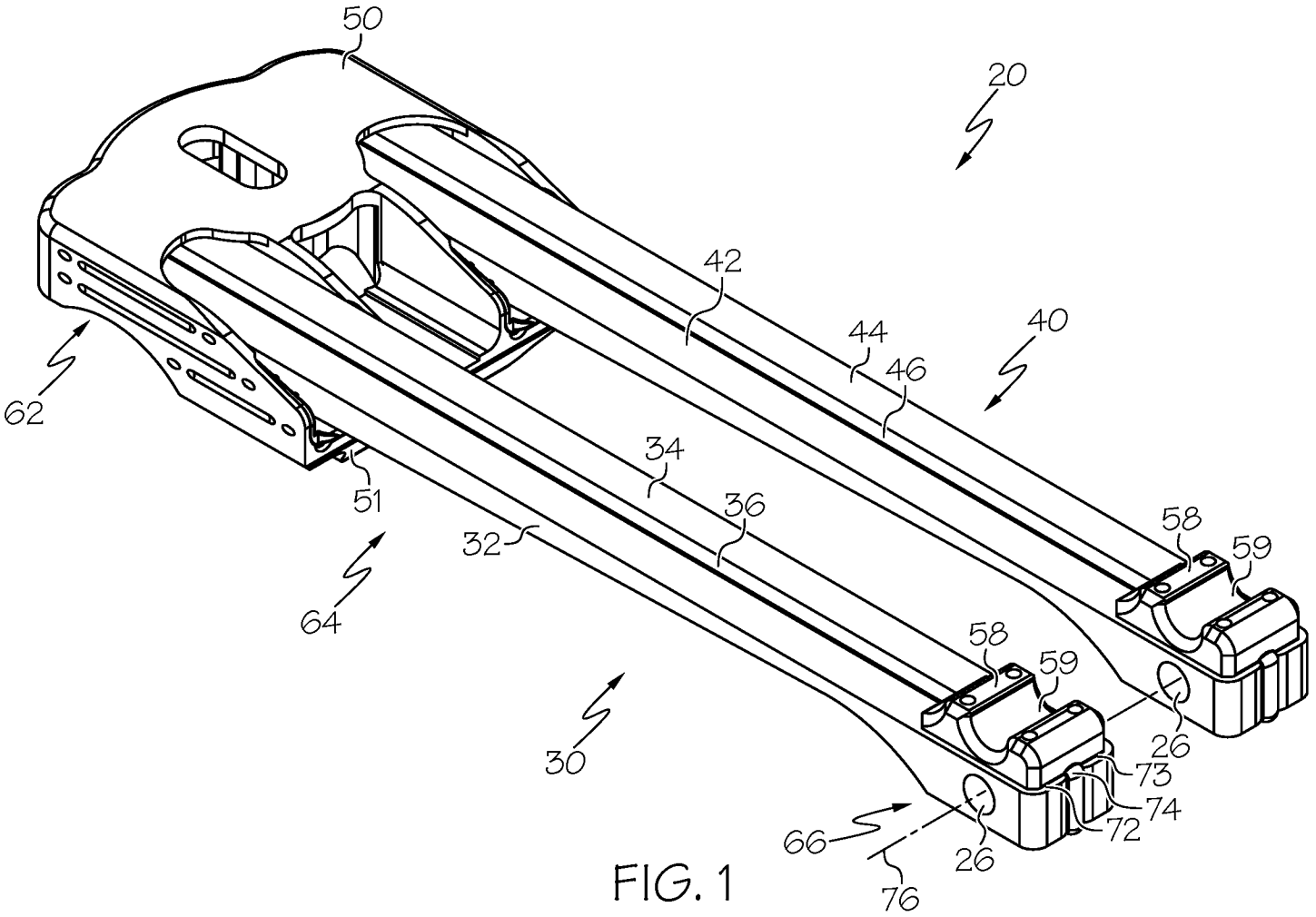
FIG. 1 shows an embodiment of a limb construction.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
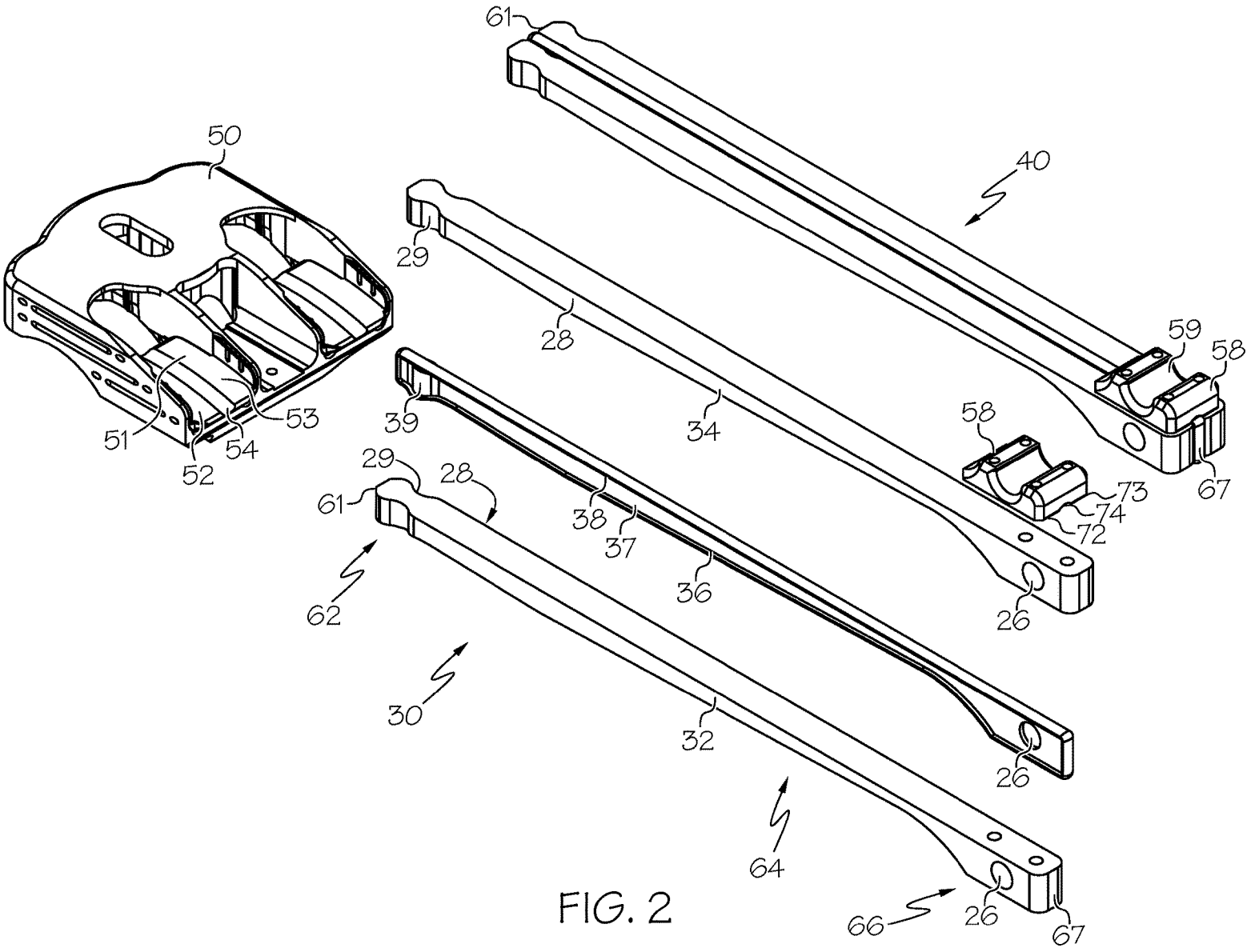
FIG. 2 shows a partially exploded view of the embodiment of FIG. 1.

FIG. 1 shows an embodiment of a limb construction 20. FIG. 2 shows a partially exploded view of the embodiment of FIG. 1.

In some embodiments, a limb assembly 30 comprises a first limb 32 and a second limb 34. In some embodiments, the first limb 32 and second limb 34 each comprise a first material, such as a composite material comprising reinforcing fibers and resin, or any other suitable known archery bow limb material. In some embodiments, the limb assembly 30 comprises a spacer 36. In some embodiments, the spacer 36 comprises a second material that is different from the first material. In some embodiments, the second material is generally more flexible than the first material, for example having a lower elastic modulus. In some embodiments, the second material is highly flexible as compared to the first material and the spacer 36 acts as a shock absorber or vibration damper.

In some embodiments, a spacer 36 can comprise any suitable material. In some embodiments, a spacer 36 comprises a polymer. In some embodiments, a spacer 36 comprises a thermoplastic material. In some embodiments, a spacer 36 comprises a thermoset material. In some embodiments, a spacer 36 comprises an elastomeric material. In some embodiments, a spacer 36 comprises a thermoplastic elastomer. In some embodiments, a spacer 36 comprises a thermoplastic vulcanisate. In some embodiments, a spacer 36 comprises thermoplastic polyurethane. In some embodiments, a spacer 36 comprises a single material having a unitary construction. In some embodiments, a spacer 36 is formed by a molding process, such as injection molding. In some embodiments, a spacer 36 comprises a fabric, cloth, felt or other suitable textile formed from fibers comprising any suitable material.

In some embodiments, a limb assembly 30 comprises a first engagement region 62, a working length portion 64 and a second engagement region 66. In some embodiments, the first engagement region 62 is arranged to engage a support, such as a limb cup 50. In some embodiments, the working length portion 64 extends between the first engagement region 62 and the second engagement region 66. In some embodiments, the second engagement region 66 is arranged to engage and support another portion of an archery bow, such as an axle.

In some embodiments, the spacer 36 contacts a side surface 28 of the first limb 32. In some embodiments, the spacer 36 contacts a side surface 28 of the second limb 34. In some embodiments, the spacer 36 is compressed between the first limb 32 and the second limb 34. In some embodiments, the spacer 36 contacts a side surface 28 of the entire working length portion 64 of the first limb 32. In some embodiments, the spacer 36 contacts a side surface 28 of the entire working length portion 64 of the second limb 34.

In some embodiments, the first limb 32 and the second limb 34 comprise a similar longitudinal cross-sectional shape. In some embodiments, the spacer 36 comprises a longitudinal cross-sectional shape similar to the first limb 32. In some embodiments, the spacer 36 comprises a body portion 37 and a flange 38. In some embodiments, the flange 38 is wider than the body portion 37. In some embodiments, the body portion 37 contacts a side surface of a limb 32, 34 and the flange 38 is arranged to contact respective top, bottom and/or end surfaces of the limb 32, 34.

In some embodiments, a limb 32, 34 comprises a recess 29. In some embodiments, a recess 29 is formed in a side surface 28. In some embodiments, the first engagement region 62 comprises the recess 29. In some embodiments, the spacer 36 comprises a protrusion 39. In some embodiments, the body 37 comprises the protrusion 39. In some embodiments, a protrusion 39 comprises an increased width dimension in the spacer 36. In some embodiments, the protrusion 39 comprises a first side oriented in a recess 29 in the first limb 32 and a second side oriented in a recess in the second limb 34.

In some embodiments, the second engagement region 66 of a limb assembly 30 is arranged to support an axle. In some embodiments, the limb assembly 30 comprises an aperture 26, for example arranged to receive an axle. In some embodiments, the first limb 32, the spacer 36 and the second limb 34 each comprise apertures 26 that are aligned with one another.

In some embodiments, the spacer 36 contacts an entire side surface 28 of a limb 32, 34 continuously, for example from a first end 61 to a second end 67. In some embodiments, the body portion 37 contacts an entire side surface 28 of a limb 32, 34 continuously.

In some embodiments, a limb assembly 30 comprises a bearing accessory 58. In some embodiments, a bearing accessory 58 is attached to the second engagement region 66. In some embodiments, a bearing accessory 58 comprises features as disclosed in U.S. Pat. No. 9,389,040, the entire content of which is hereby incorporated herein by reference.

In some embodiments, a bearing accessory 58 comprises a cavity 59 arranged to engage a bow press. In some embodiments, a bearing accessory 58 comprises a single piece of material. In some embodiments, a bearing accessory 58 is attached to a first limb 32 and is attached to a second limb 34. In some embodiments, the bearing accessory 58 comprises a surface 72 arranged to contact the first limb 32 and the second limb 34. In some embodiments, the surface 72 is planar. In some embodiments, a bearing accessory 58 comprises a first surface 72 and a second surface 73 separated by a groove 74. In some embodiments, the first surface 72 contacts the first limb 32 and the second surface 73 contacts the second limb 34. In some embodiments, the first surface 72 is coplanar with the second surface 73. In some embodiments, the groove 74 provides clearance for a spacer 36. In some embodiments, a fastener, such as a screw, abuts and passes through a limb 32, 34, 42, 44 and engages a bearing accessory 58. In some embodiments, a bearing accessory 58 comprises a plurality of threaded holes to engage fasteners for securement to a limb assembly 30, 40.

In some embodiments, a limb assembly 30 is engaged with a limb cup 50. In some embodiments, a limb cup 50 is arranged to be supported by a part of an archery bow, such as a riser. In some embodiments, a limb cup 50 and a limb assembly 30 comprise engagement features as disclosed in U.S. Pat. No. 8,453,635, the entire content of which is hereby incorporated herein by reference.

In some embodiments, a limb cup 50 comprises a limb pad 51. In some embodiments, a limb pad 51 comprises a first surface 52 and a second surface 53 separated by a groove 54. In some embodiments, the first surface 52 and second surface 53 comprise curvature in a longitudinal direction of a limb assembly 30. In some embodiments, the first surface 52 extends parallel to the second surface 53. In some embodiments, the first limb 32 contacts the first surface 52 and the second limb 34 contacts the second surface 53. In some embodiments, the groove 54 provides clearance for the spacer 36.

In some embodiments, a limb assembly 30 is supported at the first engagement region 62 by a moment connection, for example provided by an archery bow riser or a limb cup 50. In some embodiments, the moment connection comprises a first force applied to a tension surface (e.g. top surface) of a limb 32, 34 and a second force applied to a compression surface (e.g. bottom surface) of a limb 32, 34. In some embodiments, the second force is applied to the limb 32, 34 by a limb pad 51. In some embodiments, a spacer 36 extends across the location of the second force. In some embodiments, a spacer 36 extends across the limb pad 51. In some embodiments, the spacer 36 extends continuously between the location of the second force and the location of the first force. In some embodiments, the spacer 36 extends continuously across the portion of the limb 32, 34 oriented in the limb cup 50. In some embodiments, a spacer 36 extends continuously from the location of the limb pad 51 through the working length portion 64 of the limb 32, 34. In some embodiments, a spacer 36 extends continuously from the location of the limb pad 51 through the second engagement region 66 of the limb 32, 34.

FIG. 1 shows an embodiment of a limb construction 20 suitable for use in an archery bow, such as a compound bow. In some embodiments, a limb construction 20 comprises a first limb assembly 30 as described herein. In some embodiments, the limb construction 50 comprises a second limb assembly 40. In some embodiments, the second limb assembly 40 comprises a third limb 42, a fourth limb 44 and a second spacer 46. In various embodiments, the parts of the second limb assembly 40 may be similar to parts of the first limb assembly 30 as described herein.

In some embodiments, the second limb assembly 40 is similar to the first limb assembly 30. In some embodiments, an aperture 26 of the second limb assembly 40 is arranged on a common axis 76 with an aperture 26 of the first limb assembly 30. In some embodiments, the limb construction 20 supports an axle, which supports a cam or rotating member. In some embodiments, the first limb assembly 30 is oriented to a first side of a rotating member and the second limb assembly 40 is oriented to a second side of the rotating member (see also FIG. 6).

Figure 3:
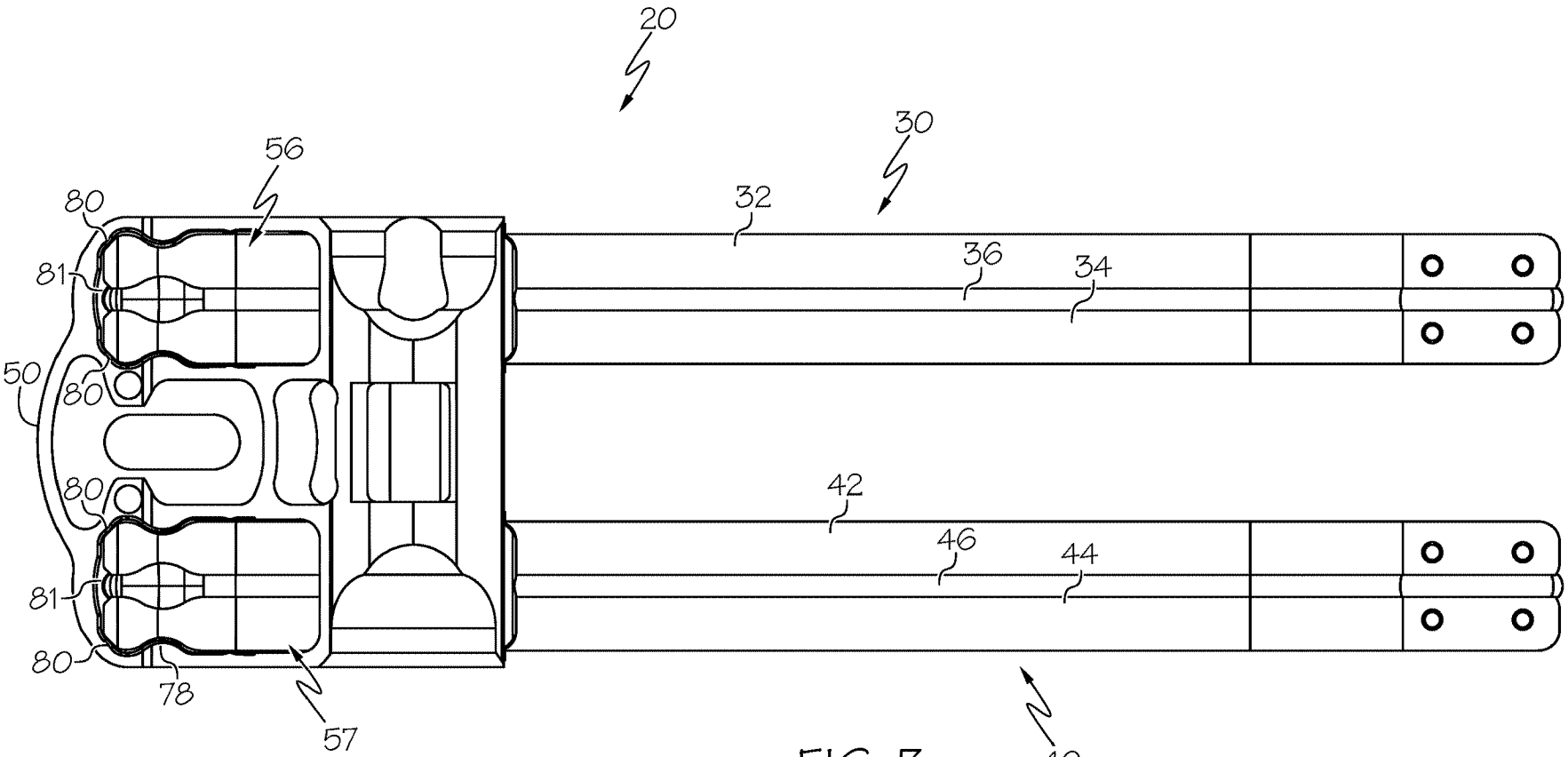
FIG. 3 shows a bottom view of an embodiment of a limb construction.

FIG. 3 shows a bottom view of an embodiment of a limb construction 20. In some embodiments, the limb cup 50 comprises a first cavity 56 arranged to receive the first limb assembly 30 and a second cavity 57 arranged to receive the second limb assembly 40. In some embodiments, a cavity 56, 57 comprises at least one protrusion 78 arranged to engage a sidewall of the limb assembly 30, 40. In some embodiments, a cavity 56, 57 comprises a pair of diverging surfaces 80 arranged in a V-shape. In some embodiments, each diverging surface 80 of a given pair is arranged to contact one of the limb members 32, 34, 42, 44 of a respective limb assembly 30, 40. In some embodiments, a cavity 56, 57 comprises an airspace 81 located between the pair of diverging surfaces 80. In some embodiments, the airspace 81 provides clearance for a spacer 36, 46.

Figure 4:
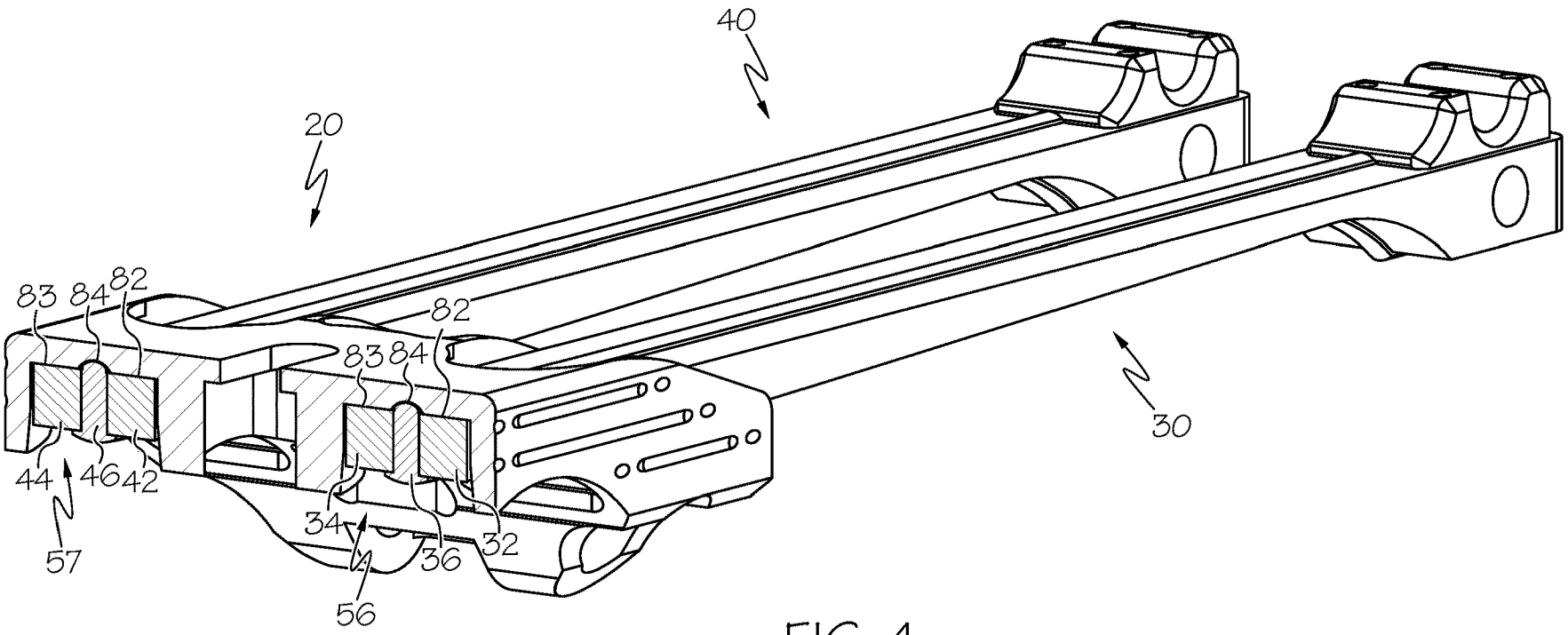
FIG. 4 shows a cross-sectional view of an embodiment of a limb cup and embodiments of limb assemblies.

FIG. 4 shows a cross-sectional view of an embodiment of a limb cup 50 and embodiments of limb assemblies 30, 40. In some embodiments, a cavity 56, 57 comprises a first surface 82 and a second surface 83 separated by a groove 84. In some embodiments, the first surface 82 contacts the first limb 32 of a limb assembly 30 and the second surface 83 contacts the second limb 34 of the limb assembly 30. In some embodiments, the groove 84 provides clearance for a spacer 36.

Figure 5:
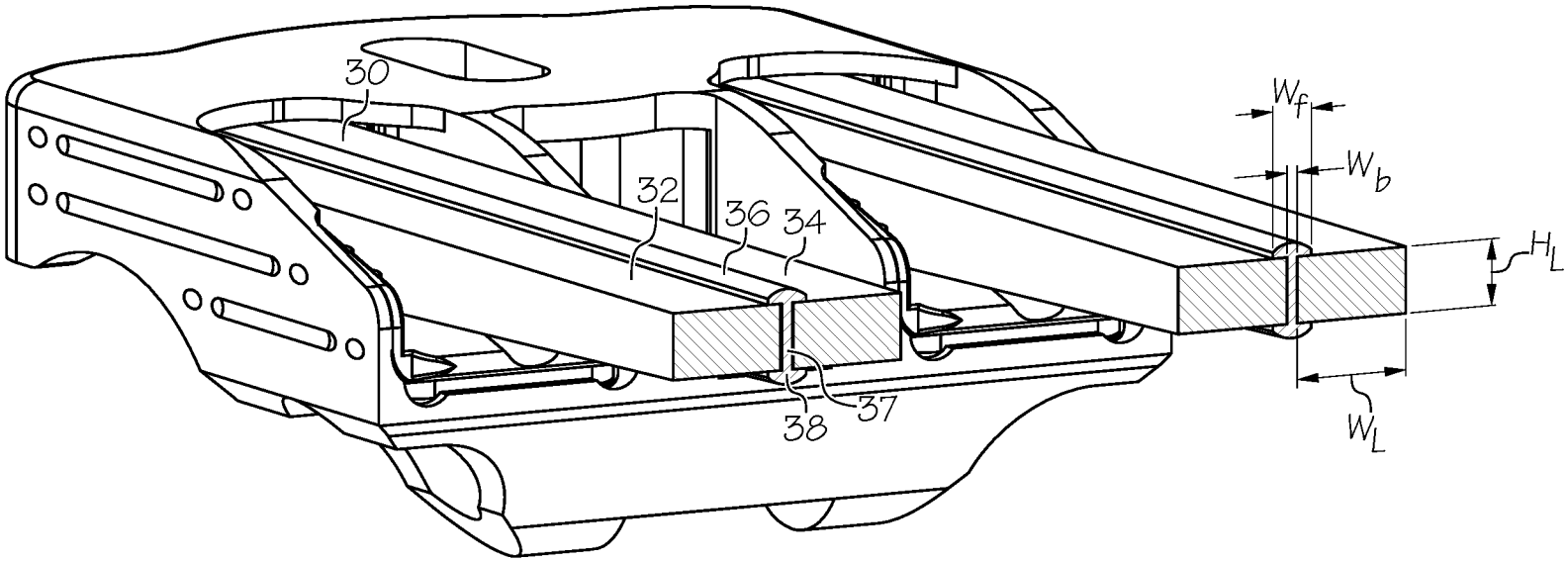
FIG. 5 shows a cross-sectional view of embodiments of limb assemblies.

FIG. 5 shows a cross-sectional view of embodiments of a first limb assembly 30 and a second limb assembly 40. In some embodiments, a width $w_b$ of the body 37 of a spacer 36 is less than a width $w_l$ of a limb 32, 34. In some embodiments, a width $w_f$ of the flange 38 is greater than a width $w_b$ of the body 37.

In some embodiments, the width of a spacer 36 is less than the width of the first limb 32 and less than the width of the second limb 34. In some embodiments, the width of the body $w_b$ of a spacer 36 is less than the width of the first limb 32 and less than the width of the second limb 34. In some embodiments, the width of the flange $w_f$ of a spacer 36 is less than the width of the first limb 32 and less than the width of the second limb 34.

Figure 6:
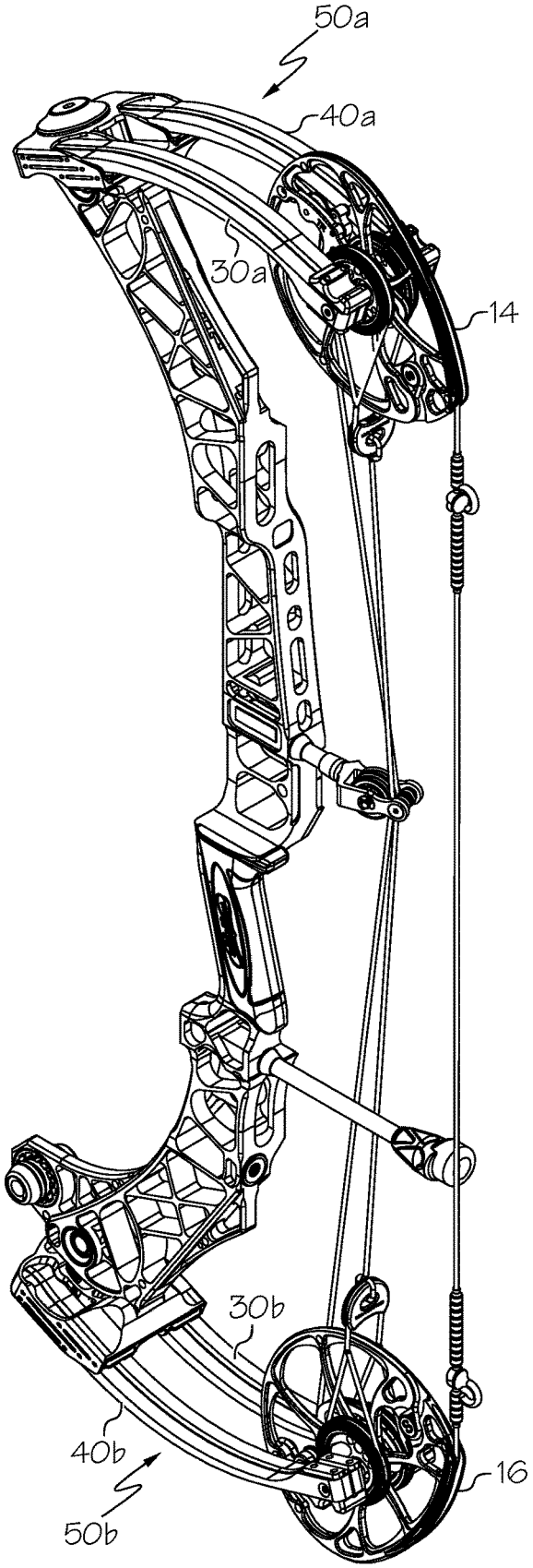
FIG. 6 shows an embodiment of an archery bow.

FIG. 6 shows an embodiment of an archery bow 10 comprising a first limb construction 50*a* arranged to support a first rotatable member 14 and a second limb construction 50*b* arranged to support a second rotatable member 16.

In some embodiments, a first limb 32 and a second limb 34 each comprise a coating, such as a powder coated paint. In some embodiments, a spacer 36 contacts the coating of the first limb 32 and contacts the coating of the second limb 34.

In various embodiments, a spacer 36 can have any suitable size and shape. In some embodiments, a spacer 36 fills a gap between limbs (e.g. 32, 34). In some embodiments, a spacer 36 acts as an energy damper. In some embodiments, a limb assembly 30 comprises multiple spacer 36 members distributed along the length of the limb assembly 30. In some embodiments, a first spacer is oriented in a first engagement region 62. In some embodiments, second spacer is oriented in a second engagement region 66.

In some embodiments, the limbs 32, 34 that comprise a limb assembly 30 are similar to one another, for example comprising similar materials and dimensions. In some embodiments, the limbs 32, 34 that comprise a first limb assembly 30 are similar to the limbs 42, 44 that comprise a second limb assembly 40. For example, in some embodiments, a third limb 42 is similar to a first limb 32, for example comprising similar materials and dimensions. In some embodiments, a third limb 42 is similar to a second limb 34, for example comprising similar materials and dimensions.

In some embodiments, various limb members 32, 34, 42, 44 can be different from one another.

In some embodiments, a first limb 32 that contacts a spacer 36 is different from a second limb 34 that contacts the spacer 36, such that the first limb 32 provides a different amount of supporting force to an axle than the second limb 34. In some embodiments, a first limb 32 and a second limb 34 can comprise similar materials but have different dimensions. In some embodiments, a thickness profile of a second limb 34 is different from the thickness profile of a first limb 32.

Figure 7:
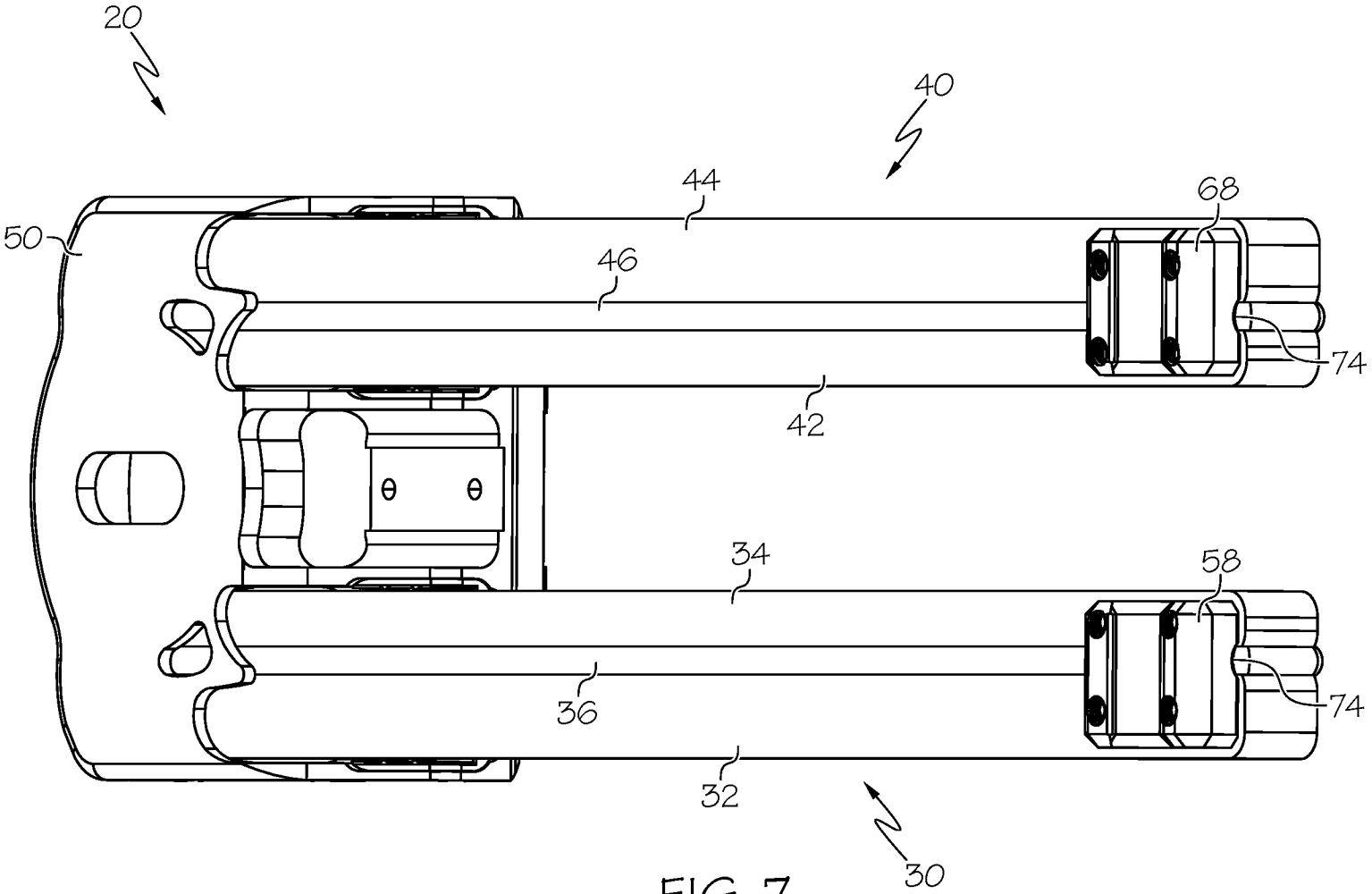
FIGS. 7 and 8 show another embodiment of a limb construction.
Figure 8:
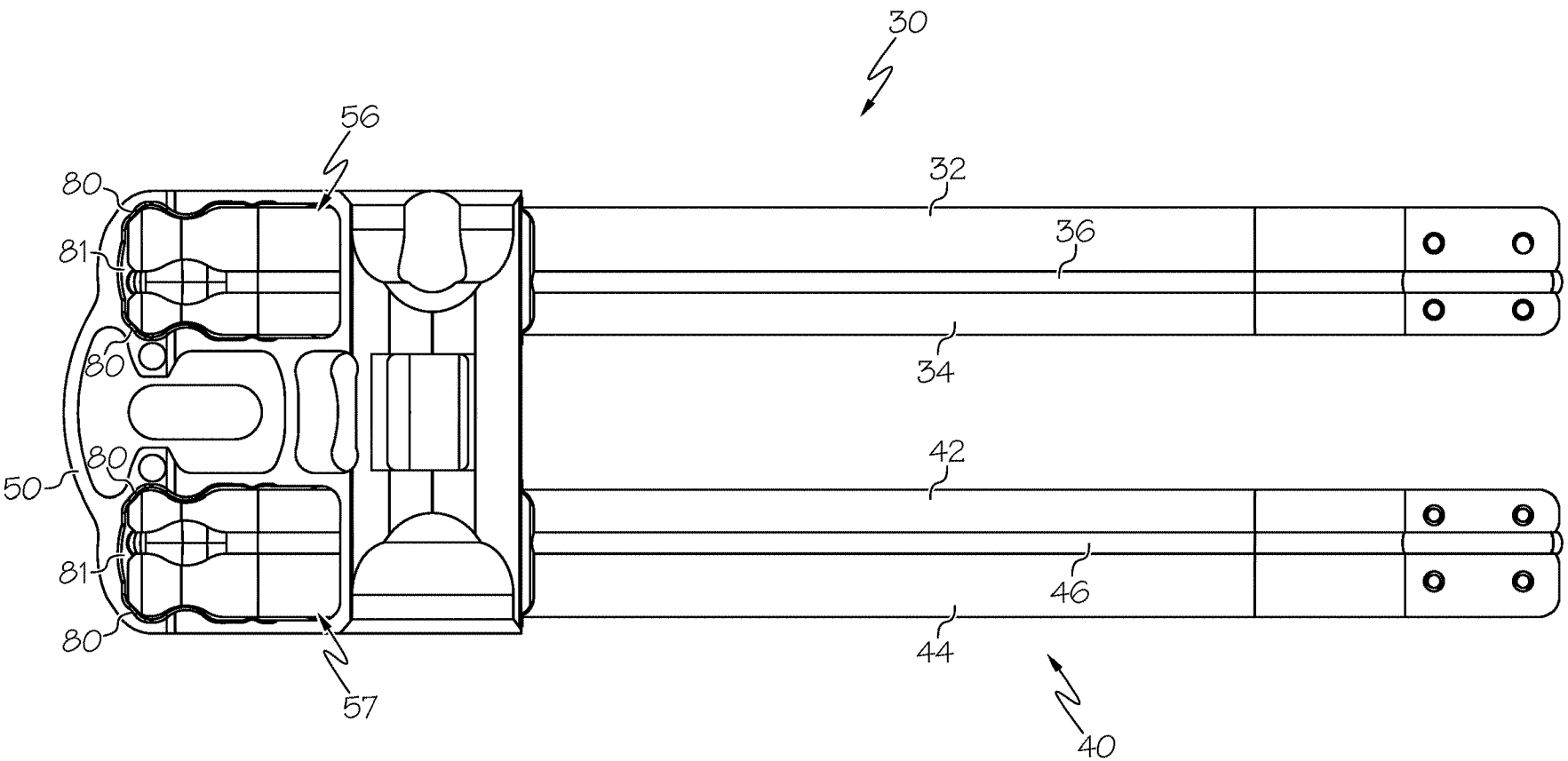

FIGS. 7 and 8 show another embodiment of a limb construction 20. In some embodiments, a first limb 32 comprises a width $w_l$ (see FIG. 5) that is different from a width $w_l$ of a second limb 34. In some embodiments, a first limb 32 comprises a greater width $w_l$ than a second limb 34. In some embodiments, a spacer 36 is offset from a longitudinal midplane of a limb assembly 30. In some embodiments, a spacer 36 extends parallel to a longitudinal midplane of the limb assembly 30.

In some embodiments, a second limb assembly 40 comprises a mirror image of a first limb assembly 30. In some embodiments, a first limb 32 comprises a greater width $w_l$ than a second limb 34 and a third limb 42 comprises a greater width $w_l$ than a fourth limb 44. In some embodiments, a first limb 32 is sized and shaped similar to a fourth limb 44 and a second limb 34 is sized and shaped similar to a third limb 42. In some embodiments, a second spacer 46 is offset from a longitudinal midplane of a second limb assembly 40. In some embodiments, a second spacer 46 extends parallel to a longitudinal midplane of the second limb assembly 40.

In some embodiments, a bearing accessory 58 comprises a groove 74. In some embodiments, the groove 74 is offset from a longitudinal midplane of the bearing accessory. In some embodiments, a first bearing accessory 58 comprises a mirror image of a second bearing accessory 68.

A limb assembly 30 as disclosed herein can be used on any suitable type of archery bow. In some embodiments, an archery bow comprises a non-compound or recurve style bow, for example comprising a bowstring that attaches directly to the limb assembly 30. In some embodiments, a bowstring contacts a first limb 32 and a second limb 34. In some embodiments, the bowstring further contacts a spacer 36.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow limb assembly comprising:

a first limb, a second limb and a spacer, the first limb comprising a first tension surface, a first compression surface and a first side surface, the second limb comprising a second tension surface, a second compression surface and a second side surface, the spacer contacting the first side surface and the second side surface, the first limb comprising a limb material, the spacer comprising a spacer material comprising a lower elastic modulus than the limb material, a width of the spacer being less than a width of the first limb, the spacer comprising a body portion and a flange, the flange comprising a greater width than the body portion, the flange contacting the first tension surface, the flange contacting the second tension surface.

2. The archery bow limb assembly of claim 1, the first limb comprising a first engagement region arranged to be supported by a limb cup, the spacer contacting the first engagement region.

3. The archery bow limb assembly of claim 2, the first limb comprising a working length portion, the spacer contacting the working length portion.

4. The archery bow limb assembly of claim 1, the first limb comprising a second engagement region arranged to support an axle or bowstring, the spacer contacting the second engagement region.

5. The archery bow limb assembly of claim 1, the flange contacting a first end surface of the first limb.

6. The archery bow limb assembly of claim 5, the flange contacting a second end surface of the first limb.

7. The archery bow limb assembly of claim 1, the flange contacting the first compression surface of the first limb, the flange contacting the second compression surface of the second limb.

8. The archery bow limb assembly of claim 1, wherein the spacer extends an entire length of the first limb.

9. The archery bow limb assembly of claim 1, comprising a bearing accessory attached to the first limb and the second limb.

10. The archery bow limb assembly of claim 1, comprising a limb cup arranged to support the first limb and the second limb, the limb cup comprising a groove, a portion of the spacer oriented in the groove.

11. The archery bow limb assembly of claim 1, the first limb comprising a different width from the second limb.

12. The archery bow limb assembly of claim 1, the limb material comprising a composite material comprising reinforcing fibers, the spacer comprising an elastomeric material.

13. An archery bow limb assembly comprising:

a first limb, a second limb and a spacer, the spacer contacting the first limb and the second limb, the first limb comprising a limb material, the spacer comprising a spacer material comprising a lower elastic modulus than the limb material, a width of the spacer being less than a width of the first limb;

the first limb comprising an aperture arranged to receive an axle, the spacer comprising an aperture arranged to receive the axle.

14. An archery bow limb assembly comprising:

a first limb, a second limb and a spacer, the spacer contacting the first limb and the second limb, the first limb comprising a limb material, the spacer comprising a spacer material comprising a lower elastic modulus than the limb material, a width of the spacer being less than a width of the first limb;

a sidewall of the first limb comprising a first lateral recess, the spacer comprising a protrusion oriented in the first lateral recess.

15. The archery bow limb assembly of claim 14, a sidewall of the second limb comprising a second lateral recess, the protrusion comprising a first side and a second side, the first side oriented in the first lateral recess, the second side oriented in the second lateral recess.

16. An archery bow limb assembly comprising:

a first limb, a second limb and a spacer, the first limb comprising a first tension surface, a first compression surface and a first side surface, the second limb comprising a second tension surface, a second compression surface and a second side surface, the spacer contacting the first side surface and the second side surface, the first limb comprising a limb material, the spacer comprising a spacer material comprising a lower elastic modulus than the limb material, a width of the spacer being less than a width of the first limb;

a bearing accessory attached to the first limb and the second limb, the bearing accessory comprising a groove, a portion of the spacer oriented in the groove.

* * * * *